United States Patent [19]

Price

[11] 4,015,791

[45] Apr. 5, 1977

[54] APPARATUS FOR SLITTING BELT MATERIAL

[76] Inventor: John G. Price, Box 3197, Montgomery, Ala. 36109

[22] Filed: Feb. 6, 1976

[21] Appl. No.: 655,998

[52] U.S. Cl. ..... 242/56.2; 242/58.6

[51] Int. Cl.² ..... B65H 35/02; B65H 19/30

[58] Field of Search ..... 242/56.2, 58.6, 56.3, 242/56.4, 56.5, 67.3, 56 R

[56] References Cited

UNITED STATES PATENTS

| | | | |
|---|---|---|---|
| 3,075,719 | 1/1963 | Hornstein | 242/56.2 X |
| 3,321,147 | 5/1967 | Martin | 242/58.6 |
| 3,685,756 | 8/1972 | Marx | 242/56.2 |

*Primary Examiner*—Edward J. McCarthy
*Attorney, Agent, or Firm*—Sherman & Shalloway

[57] ABSTRACT

An apparatus for longitudinally slitting a roll of sheet material is disclosed. The apparatus comprises a frame having a supply roll shaft mounted at one end and a take-up roll shaft mounted at the other end, the take-up roll being connected to a drive means. A knife means adjustably mounted on the frame is located between the supply and take-up rolls. The frame is pivotably mounted on a support frame and driven by hydraulic means so as to permit the tilting or lowering of either end of the frame to allow loading and/or unloading of the supply and take-up rolls as well as maintaining a horizontal working position for the frame.

7 Claims, 5 Drawing Figures

APPARATUS FOR SLITTING BELT MATERIAL

BACKGROUND OF THE INVENTION

1. Field of the Invention

This invention relates to methods and apparatuses for handling belts and, more particularly, to methods and apparatuses for slitting belts and like materials.

2. Description of the Prior Art

Heretofore machines for slitting belts or like materials have been difficult to load and operate and have not been suitable for slitting a large variety of belt types. In addition, the loading operation required the use of additional personnel and equipment for loading or unloading the apparatus such as by fork-lift trucks, overhead hoists, and the like.

U.S. Pat. No. 2,569,589 of Trisell shows one such prior machine. In this patent, the original stock roll of belt to be slit must be handled by a vehicle or by several workmen in order that it may be positioned on a spindle of the machine. This is undesirable since the workmen or vehicle are kept from doing other productive work each time it is necessary to load or unload the machine.

Another prior art machine is shown in U.S. Pat. No. 2,827,961 of Pugh. In the machine shown in this patent, many of the same disadvantages are mentioned as are present in the Trisell machine. Another undesirable feature of this machine is that the belt must be slit by hand prior to engagement with the cutter.

U.S. Pat. No. 3,685,756 of Marxs, et al. discloses the use of power controlled lift arms for raising and lowering spindles either to load or unload the machine or to vary the height of the spindles during operation of the machine. There are further needed in the Marxs, et al. apparatus pneumatically operated supporting pins which provide for mounting the spindle between the lift arms and locking it for rotation on the lift arms.

SUMMARY OF THE INVENTION

The present invention pertains to machines and methods for slitting belts or similar materials, and to methods which improve belt handling procedures. The apparatus of the present invention includes a frame having first and second ends, a supply roll shaft mounted for rotation at one end of the frame, a take-up roll shaft mounted for rotation at the other end of the frame, means for rotating at least said take-up roll, a knife means adjustably mounted on the frame between the guide and feed rolls, the improvement in the apparatus comprising means for tilting the work portion of the frame on one end so as to load the stock roll, raising the upper portion of the frame to a horizontal work position for slitting the sheet material and then tilting the other end of the upper frame to the floor so as to remove the slit material from the apparatus by rolling onto the floor.

A further feature of the present invention is the technique of its use of a pressure roller over a nip roller so as to apply pressure against a belt passing over the nip roller which in turn is driven by a hydraulic motor so as to transfer the belt from one end of the machine to the other end of the machine. At the same time, the knife means is pushed into the belt to initiate the slitting operation. Still further, the knife means may be withdrawn, raised and adjusted or moved into position at any time since they are controlled on the means they are mounted by hydraulic means.

BRIEF DESCRIPTION OF THE DRAWINGS

A better understanding of the present invention can be acquired by reading the ensuing specification in conjunction with the accompanying drawings wherein.

DESCRIPTION OF THE PREFERRED EMBODIMENTS

Figure 1:
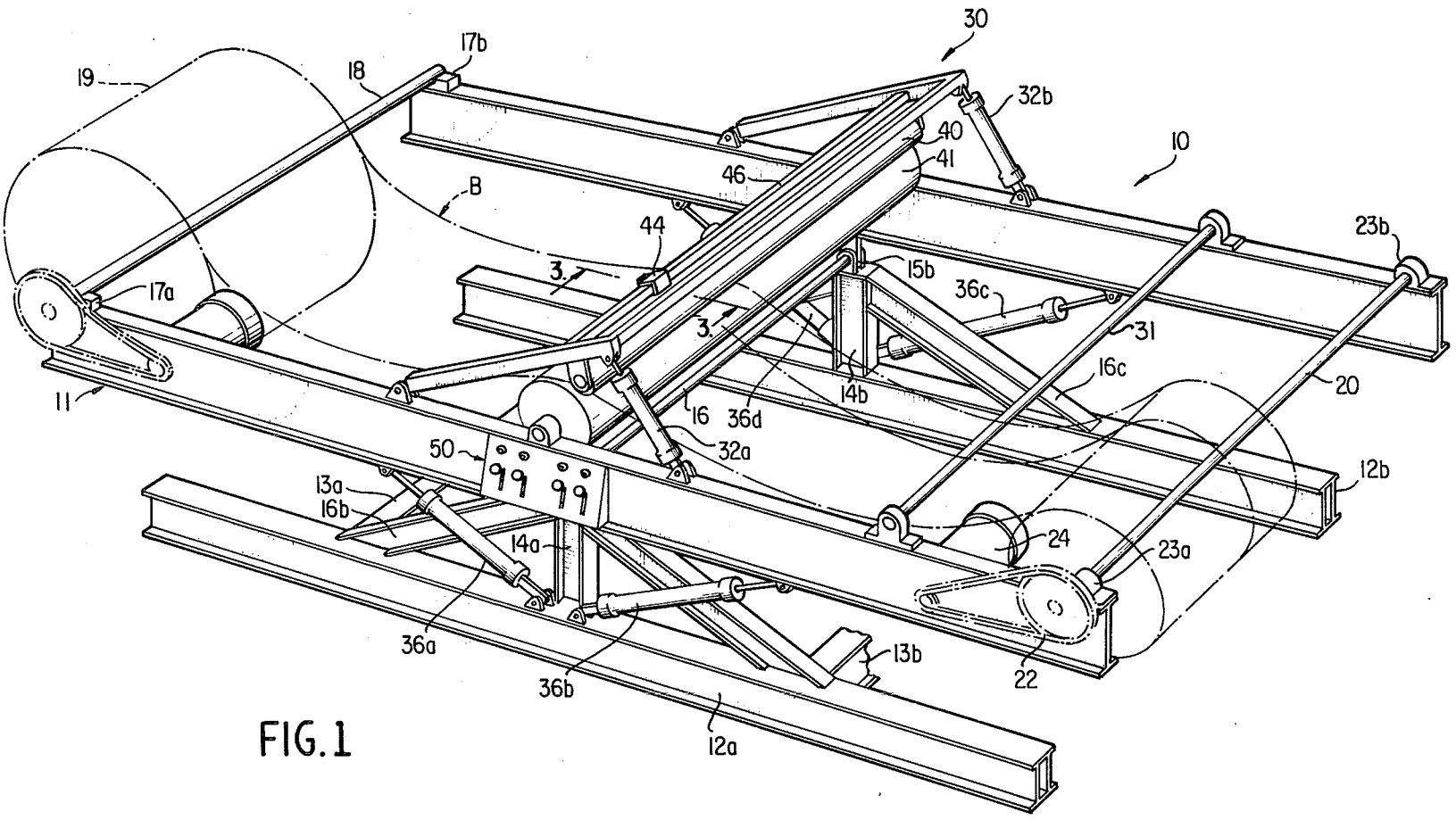
FIG. 1 is a perspective view showing a belt slitting machine embodying the principles of the invention and which is suitable for performing the several methods of the invention.

A belt-slitting machine embodying the apparatus features of the present invention and suitable for carrying out the method features of the invention is best shown generally in FIG. 1. The machine 10 comprises a frame 11 rigidly mounted on a pair of vertical frame members 14A and 14B by means of a pair of pivots 15A and 15B. Connecting pivots 15A and 15B is a support rail 16. Vertical frame members 14A and 14B are fixedly mounted on a pair of floor support members 13A and 13B and supported by support rails 16A, 16B, 16C and 16D (not shown).

At the left-hand end of the machine, as viewed in FIG. 1, there is provided a pair of mounts 17A and 17B which support a rotatable spindle 18 on which is mounted on a stock roll 19 of belt B. For the purpose of this description, the term stock roll will mean the roll of belt received from the belt manufacturer which is intended to be slit so as to form one or more strips of belt of a width less than a stock roll. Optionally, there may be provided means for rotating the spindle at variable speeds.

At the right-hand end of the apparatus 10 is a spindle 20 which supports spool 21 of the slit belt. Spindle 20 is supported by a pair of support brackets 23A and 23B and rotatable by means of spindle drive 22 that is driven by a motor 24. The spindle 20 takes up the belt B after slitting.

The lead end of the belt B passes across a slitting mechanism 30 which is located in the central portion of the apparatus 10. The belt B then passes at least one knife (not shown in the figure) which is mounted on the adjustable cutting mechanism 30 and interposed in the path of the belt as it passes across the slitting apparatus. After being slit, the belt B passes over a nip roller 41 under pressure of pressure roller 40 and proceeds under guide bar 31 to be taken up on spindle 20.

The cutting mechanism 30 is provided with a pair of hydraulic actuators 32A and 32B for drawing down the pressure roller 40 so as to apply pressure against the belts passing over the nip roller 41 and smultaneously lowering the cutting blade into position.

The frame 11 is connected with hydraulic actuators 36A, 36B, 36C and 36D which control the pivoting of the frame 11 about pivots 15A and 15B. As will be more fully discussed hereinafter, the hydraulic actuators 36A, 36B, 36C and 36D permit the frame 11 to pivot about the pivot members 15A and 15B so as to raise or lower either the stock roll or the split roll and to maintain the frame in the horizontal working position.

Most of the components of the machine are hydraulically powered for ease of operation and versatility. For this purpose, a control console 50 is provided centrally of the machine to give an operator push-button control of all stages of a belt slitting operation. The various pumps, motors, fluid and air supplies required for the operation of the machine are hidden behind the frame 11, thus presenting a compact, self-contained apparatus.

Figure 2:
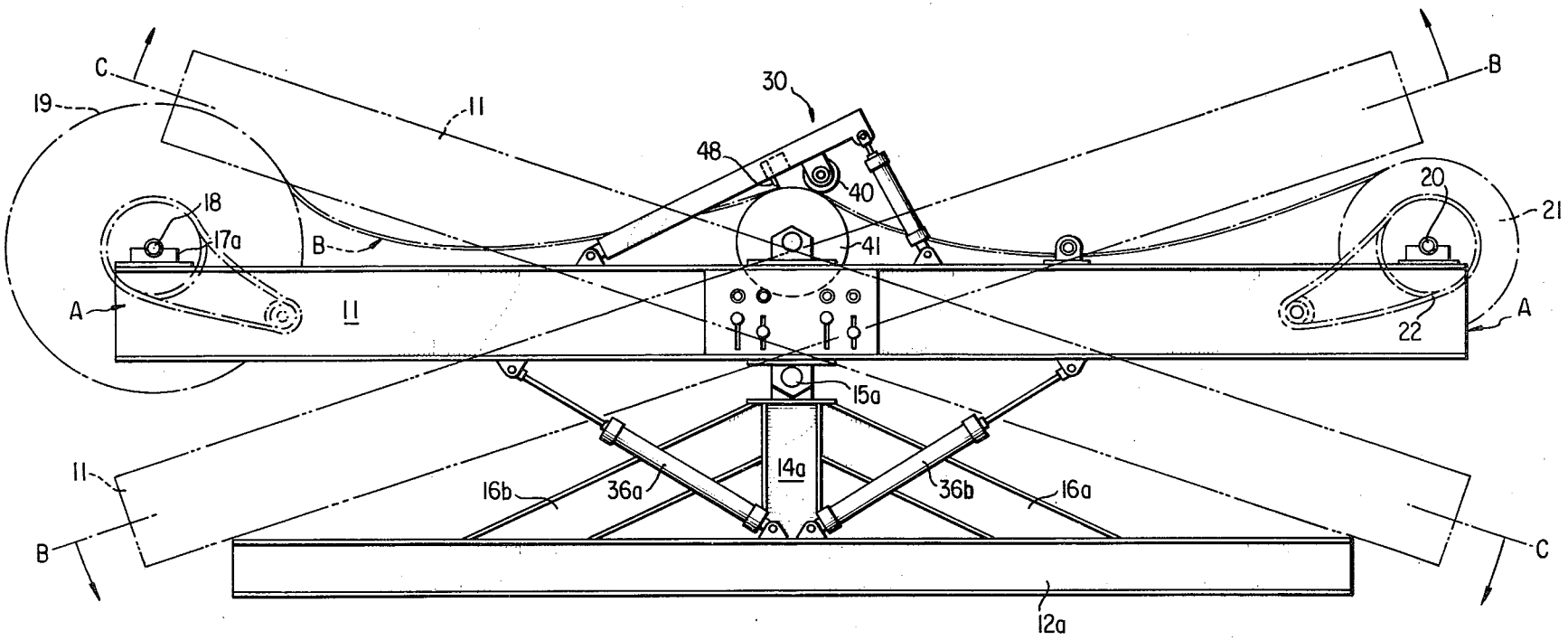
FIG. 2 is an elevational view of the slitting apparatus.

FIG. 2 illustrates the various positions that the frame can pivot. Position A—A represents the horizontal working position of the frame 11. Position B—B represents the loading position for the stock roll whereby the stock roll can be rolled onto the frame and secured by spindle 18 on mounts 17A and 17B. Position C-13 C represents the unloading position of the web after completion of the slitting operation. In this case, the slit belt 21 is rolled off the frame 11 without the necessity of any mechanical means. The raising, lowering and placing the frame 11 into the horizontal work position occurs primarily by pivoting the frame 11 about pivots 15A and 15B by means of the hydraulic actuators 36A, 36B, 36C and 36D.

Figure 3A:
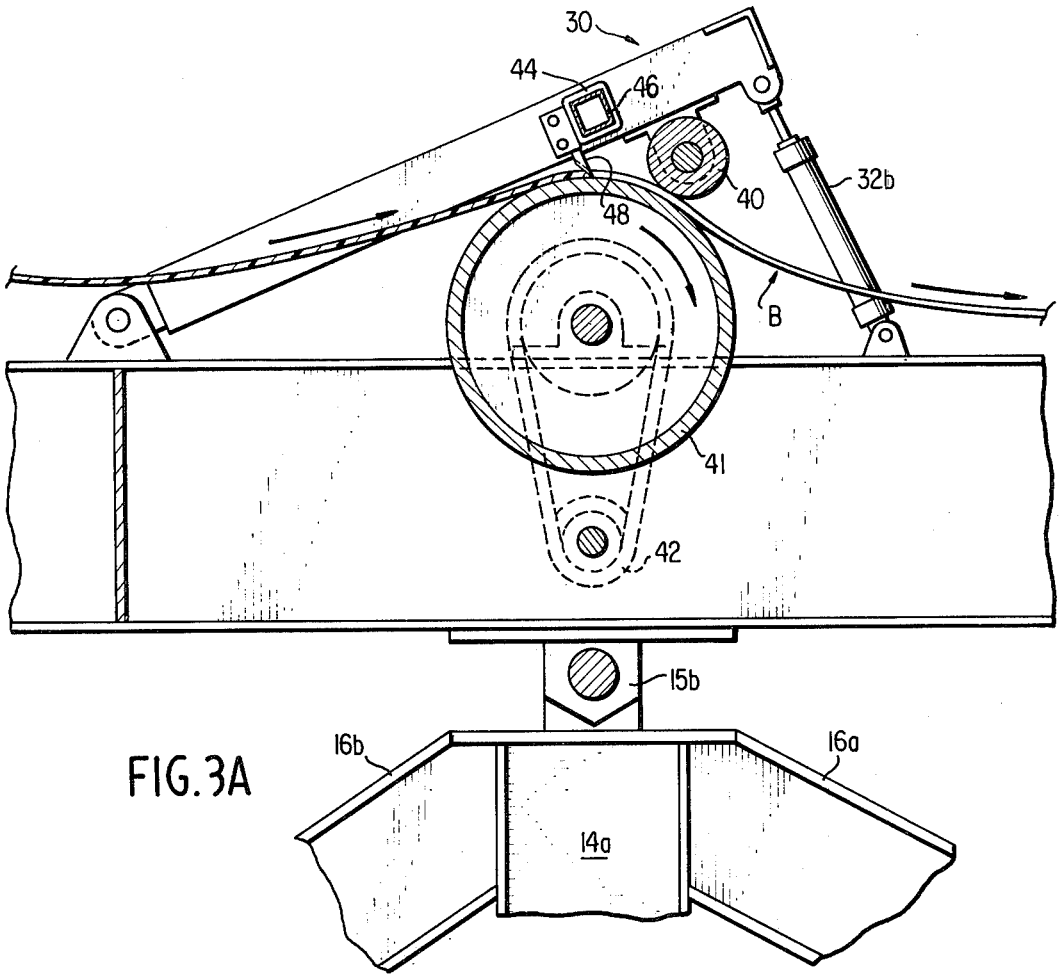
FIG. 3A is an enlarged view of the cutting mechanism of the present invention.

FIG. 3A is an enlarged sectional view taken along line 3—3 of FIG. 1 of the cutting mechanism of the present invention. As seen in FIG. 3A, the belt B passes between roller 41 driven by drive 42 with the application of pressure from roller 40. The hydraulic actuator determines the extent of pressure to be applied by roller 40. Simultaneous with the application of pressure is the slitting of the belt B by means of one or more knives 48 which are mounted by means of mount 44 on a blade support 46 of the cutting mechanism. It can be seen that as the belt material traverses the knife 48, a longitudinal slit is cut in the sheet material prior to passage between rollers 40 and 41.

Figure 3B:
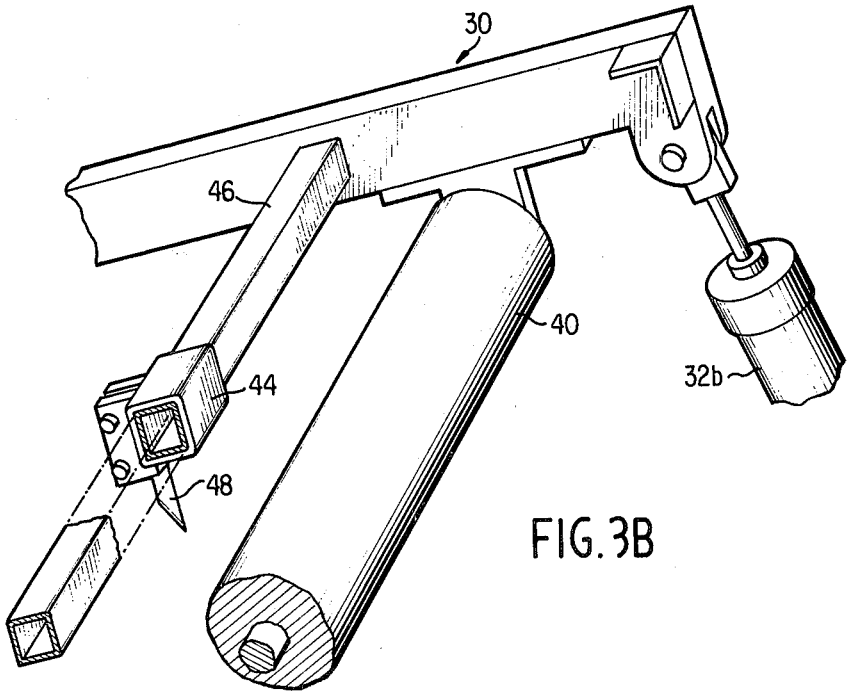
FIG. 3B is a fragmentary section taken generally along line 3—3 in FIG. 1 of the cutting mechanism.

From FIG. 3B it will be noted that the blade is mounted on support 46 in such a manner that it may be adjustably positioned along the support 46. One or more blades may be provided on the support.

The means for carrying out the slitting technique as shown in FIGS. 3A and 3B includes a blade 48 vertically adjustably secured in a mounting bracket 44. The mounting bracket may be traversed and adjustably mounted along support 46. The knife means extends the entire length of the machine and, as is well-known in the art, several blades may be adjustably mounted on the cutting mechanism for simultaneously cutting a plurality of strips from the belt. Preferably, the cutting blade 48 has a cutting edge that is inclined downwardly and rearwardly at about a 45° angle. It thus can be seen that the edge comes to a point at its lower end so that it will penetrate or pierce the belt. The inclination of the edge also assists in pushing the belt downwardly against the roller 41 as it is being cut to produce an accurate and smooth cut. A slot (not shown) may be provided on roller 41 so as to allow the cutting edge to penetrate the belt about the roller. However, the positioning of the knife means may be at any point prior to the roller means.

Thus, it can be seen that as the belt B passes across the slitting apparatus it is maintained under the constant tension by the rollers 40 and 41 and by the guide bar 31. Lateral play in the material is held to a minimum by engagement of the guide bar 31 with the belt material B.

Figure 4:
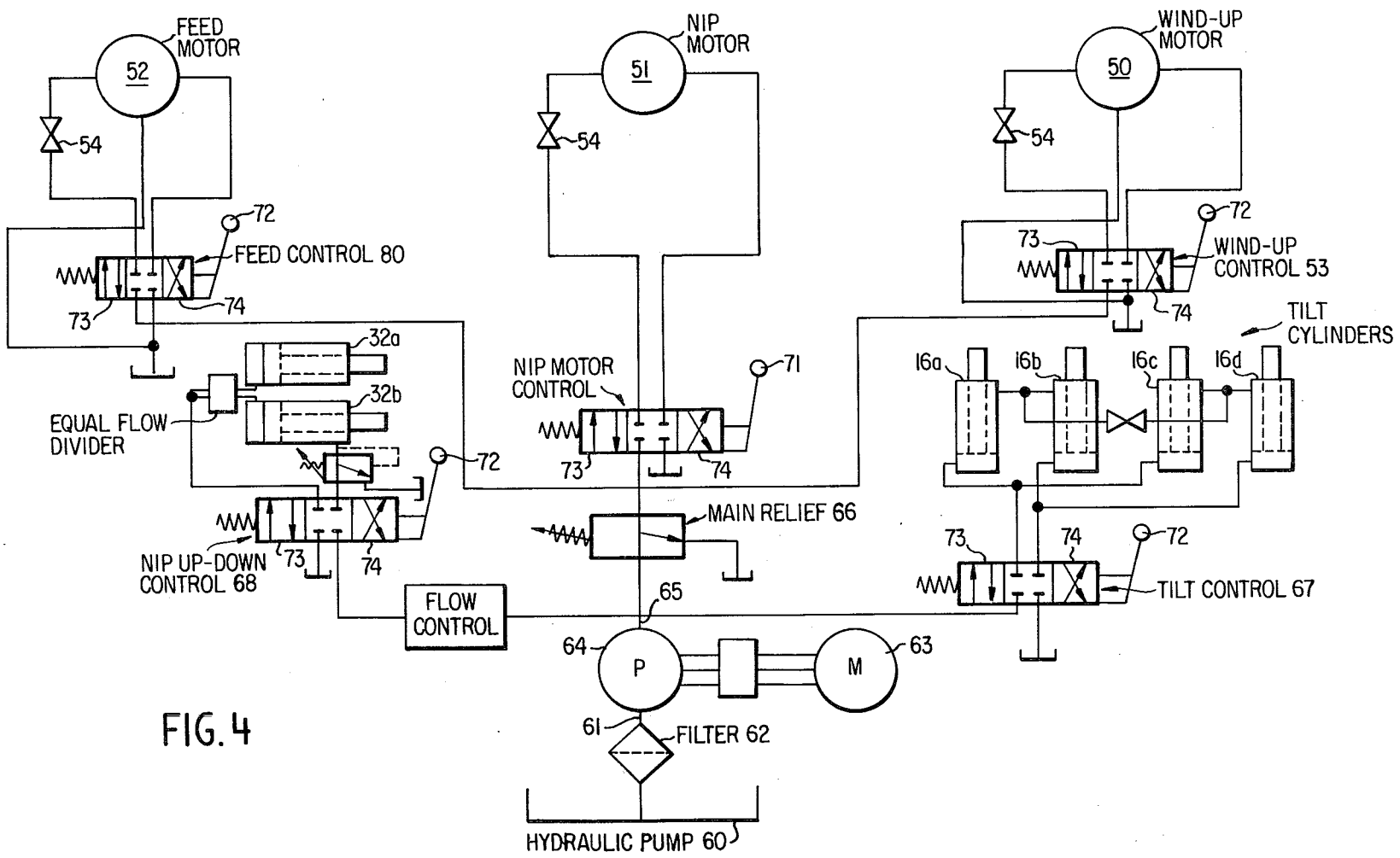
FIG. 4 is a diagram of the hydraulic circuit and controls used to operate the machine of FIG. 1.

FIG. 4 is a schematic diagram of one of the hydraulic circuitry which can be utilized in conjunction with the present invention. It is to be understood that the suitable commercial components can be utilized for purposes of the hydraulic system herein described. The preferred hydraulic circuitry utilized with the present invention provides flexibility, allows various speed adjustments of all hydraulic motors as well as powered rising and lowering of the frame.

By the use of the hydraulic control system illustrated, the speed and tensioning of the belt on the stock roll or spools may be adjusted independently of the speed of the drive rollers and may be maintained regardless of whether the machine is slitting or rewinding the belt after slitting. In other words, the system operates to control the belt tension between the drive rollers and the spindles whether the machine is running the forward or reverse direction, at any speed, and regardless of the diameters of the rolls on the spindles. The system includes a combination of separate hydraulic motors for rotating the spindles 18 and 20 and the hydraulic motor 51 for rotating the nip roller 41.

A hydraulic pump 60 is in fluid communication with a first conduit 61. A filter 62 is interposed in the inlet to conduit 61. A suitable electric motor 63 for which an on-off switch exists on the electrical console system 50 (FIG. 1) drives a variable output hydraulic pump 64. The output of pump 64 is in fluid communication with conduit 65. Conduit 65 is in fluid communication with the main relief valve 66, the tilt control 67 of the frame 11 and the nip motor control through the main relief valve 66. Each of the controls 67, 68 and 71 has actuating levers 72 which are mounted for access from the hydraulic control panel 50 (FIG. 1). Each of the controls contains a three-position four-way valve 73. As shown diagrammatically, the other two positions of valve 73 provide for forward or reverse flow through the conduits by means of their respective motors. A suitable shut-off valve may be interposed in the conduit.

The hydraulic cylinders 32A and 32B (as explained in conjunction with FIGS. 1 and 2) power the upward and downward movement of the cutting mechanism 30 and determine the amount of pressure exerted by pressure roller 40.

The hydraulic cylinders 36A, 36B, 36C and 36D (as explained in conjunction with FIG. 2) power the pivoting of the frame about pivots 15A and 15B so as to place the frame in condition for the placement of the stock roll on the frame, the removal of the split belt from the frame, or the placing of the frame in the horizontal work position.

Although there is shown in the drawing a feed control 80 together with feed motor 52 for use in the system, the use of a feed motor for the stock roll is not essential for the system since taken-up of the belt can be solely by means of the application of the wind-up system. The use of the reverse roll feed control system is preferable where tension of the belt is required and/or a rewind of the belt is required.

In operation it can be seed that the three-position four-way valve can control completely the forward the reverse directional rotation of the hydraulic motors. In addition, there may be interposed in the system modulating flow valves so that the speed of rotation of any of the hydraulic motors can be varied as desired between zero and maximum speed. It is apparent that speed modulation of each of the hydraulic motors can be accomplished independent of speed modulation of the others.

If quick stretching of a sheet of material or elastic belting being slit is desired, it is readily seen that the flow through one of the hydraulic motors 50 or 52 can be reversed by manipulation of the valve 54. This would provide for opposite rotation of the supply shaft with respect to the take-up shaft providing almost immediate stretching of the sheet material.

It is further understood that the load on each of the hydraulic motors 50 and 52 will vary depending upon the diameter of the roll or rolls of belt on the spindles. In other words, when the belt is being wound onto spools the diameters of the rolls will be small and the spools may be rotated at a high rate of speed. As the rolls build up in diameter, the speed must be reduced and the load required to turn the spools will be increased. To accommodate this increase in load and decrease in the rotational rates of the spools, the excess flow over that required to maintain the rotational speed is bypassed through the pressure relief valve 66. To accomplish this, the valve 66 is set to open to bypass when the pressure differential between the main line pressure to the valve and the bypass pressure in the valve exceeds the preset pressure. In this manner the total flow will be going through the right-hand hydraulic motor 50 when the rolls on the spools are small and the pressure required to rotate the spools is small, but as the rolls build up the pressure upstream of the right-hand hydraulic motor 50 will build up due to the increased load until the preset pressure differential is reached between the main line pressure and the bypass. When this occurs, the bypass is opened and the flow passes through a check valve.

OPERATION

To illustrate a typical operation of the machine, assume that a stock roll of belt B is to be slit. The stock roll is rolled across the floor and positioned between the frame 11 so that the spindle 18 is on mounts 17A and 17B. At this point, the frame is tilted so as to be in position B—B as shown in FIG. 2. The operator then brings the frame into the horizontal work position shown at position A—A as seen in FIG. 2. The end of belt B is then threaded between rollers 40 and 41. The cutting blade 48 is positioned on the cutting mechanism and the cutting mechanism is then lowered until the proper pressure is placed upon the belt and the cutting edge of the blade 48 pierces the belt. The belt is then fed through the machine until it is beneath the pressure roller 40. The pressure roller 40 is then lowered and the belt is fed further until it passes under the guidebar 31 and fastened onto spindle 20 for rotation on the spindle. At this time the workman tacks the end of the belt on the various spools, depending upon how many strips are being slit, and makes the final cut to separate the strips. The belt is then slit until the desired length is reached as previously determined. The slit belt is then removed by lowering the frame to the position seen at position C—C shown in FIG. 2 by tilting the frame as required. The roll may then be rolled away from the apparatus.

It should be apparent that each of the various features is separately unique and that the preferred forms illustrated are capable of variation without departing from the principles employed. Accordingly, many changes in construction and application will suggest themselves to those skilled in the art without departing from the spirit and scope of the invention.

What is claimed is:

1. An apparatus for longitudinally slitting rolled sheet material comprising:

a structural frame having first and second ends, first bracket means mounted on the first end of said frame;

a first shaft rotatably and removably mounted on said first bracket means;

second bracket means mounted on the second end of said frame;

a second shaft rotatably and removably mounted on said second bracket means;

a drinving means for reversibly driving said second shaft at a variable speed;

roller means mounted on said frame for frictionally engaging and forwarding said sheet material from said first end to said second end, said roller means including a drive roller and a driven roller;

means for raising and lowering said driven roller for placing a fixed pressure upon the sheet material passing between said roller means;

laterally adjustable knife means mounted on said means for raising and lowering said driven roller means; and hydraulically powered means for tilting said frame about an axis parallel to said first and second shafts and intermediate between the ends of said frame so as to lower said first end to permit placing of the stock roll of the belt on said first bracket means, tilting said frame to a horizontal working position and tilting said frame so as to lower said second end for removal of slit roll material from said second bracket means.

2. The apparatus of claim 1 including means for driving said first shaft at a variable speed.

3. The apparatus of claim 1 further including hydraulically powered means for raising and lowering said driven roller and for pressing said driven roller against said sheet material.

4. The apparatus of claim 1 wherein each of said drive means comprises a hydraulic motor means and a flow reversing and variable flow valve means operatively associated with said motor means for reversing and modulating the flow of hydraulic fluid to said motor means, and means for supplying hydraulic fluid to each of said motor means through said valve means.

5. The apparatus of claim 1 in which said axis is midway between the ends of said frame.

6. In an apparatus for slitting sheet material including a frame having first and second ends, a supply roll shaft mounted for rotation at one end of said frame, a take-up roll shaft mounted for rotation at the other end of said frame, means for rotating said supply roll sahft and said take-up roll shaft, a pair of roller means for advancing such sheet material from said first end to said second end, and a knife means adjustably mounted on said frame between said first end and said advance rollers, the improvement comprising:

said frame being pivotably mounted on support means; and hydraulic means for lowering said first end for placing a supply roll at said end of said frame, for tilting said frame into a horizontal work position and for tilting said frame so as to lower said second end for removal of the slit material.

7. The improvement of claim 6 further comprising hydraulic means for raising and lowering said knife means and for pressing said knife means against said knife material.

* * * * *